United States Patent [19]

Grossmann et al.

[11] Patent Number: 4,657,088

[45] Date of Patent: Apr. 14, 1987

[54] ROTARY HAMMER DRIVING MECHANISM

[75] Inventors: Horst Grossmann, Hünfelden; Klaus Kalbacher, Rangendingen; Claus Kolesch, Bad Urach; Karl Schekulin, Kirchheim-Teck Jesingen, all of Fed. Rep. of Germany

[73] Assignee: Black & Decker Inc., Newark, Del.

[21] Appl. No.: 762,715

[22] Filed: Aug. 5, 1985

[30] Foreign Application Priority Data

Aug. 8, 1984 [DE] Fed. Rep. of Germany ..... 3429140

[51] Int. Cl.[4] ..... B25D 9/00

[52] U.S. Cl. ..... 173/13; 173/48; 173/109; 173/116; 173/123

[58] Field of Search ..... 173/13, 14, 48, 47, 173/104, 109, 116, 122, 123

[56] References Cited

U.S. PATENT DOCUMENTS

| | | | |
|---|---|---|---|
| 1,841,351 | 1/1932 | Trotter | 173/123 |
| 3,650,336 | 3/1972 | Koehler | 173/116 X |
| 4,236,588 | 12/1980 | Moldan et al. | 173/48 |
| 4,325,436 | 4/1982 | Richter et al. | 173/13 |
| 4,442,906 | 4/1984 | Simpson | 173/116 X |
| 4,446,931 | 5/1984 | Bleicher et al. | 173/116 X |
| 4,456,076 | 6/1984 | Schmid et al. | 173/116 |

FOREIGN PATENT DOCUMENTS

| | | |
|---|---|---|
| 0014760 | 4/1983 | European Pat. Off. . |
| 2449191 | 5/1976 | Fed. Rep. of Germany . |
| 2839906 | 3/1980 | Fed. Rep. of Germany . |
| 3136264 | 3/1983 | Fed. Rep. of Germany . |
| 440515 | 1/1936 | United Kingdom . |
| 2048753 | 12/1980 | United Kingdom . |

*Primary Examiner*—Robert P. Olszewski

*Attorney, Agent, or Firm*—Edward D. Murphy; Dennis A. Dearing; Edward D. C. Bartlett

[57] ABSTRACT

A rotary hammer with a pneumatic impact mechanism carries on a dirve shaft, non-rotatably and non-displaceable axially relative thereto, a coupling element as well as, rotatably and displaceable axially relative thereto, a drive element. The drive element has a peripheral drive fin constituting a cam/control curve which engages between two rollers. The rollers are mounted on the rear end of a piston of the pneumatic impact mechanism with their axes of rotation perpendicular to the longitudinal axis of the piston. The drive element can at choice be brought into engagement with the coupling element. A manually operable control member may be operated to maintain the drive element out of such engagement.

11 Claims, 3 Drawing Figures

ROTARY HAMMER DRIVING MECHANISM

BACKGROUND OF THE INVENTION

The invention relates to a rotary hammer with a pneumatic impact mechanism which comprises a reciprocating piston driving a beat piece. The impact mechanism is capable of being driven by means of a drive element rotatably mounted on a driven drive shaft. The drive element can be displaced axially relative to the drive shaft and brought into engagement with a coupling element fast on the drive shaft.

In a known rotary hammer of this type (DE-OS No. 24 49 191) there is fixed or non-rotatably formed on the drive shaft a ring-shaped coupling element having an outer surface shaped as a tapering truncated cone. Also on the drive shaft there is rotatably mounted a drive element which carries in an obliquely set annular groove a rotatable ring with a radially projecting pin. This pin is in engagement with the rear end of a piston arranged in a guide tube in which there is also a beat piece between which and the piston a driving excess pressure is built up in operation, as is known for penumatic impact mechanisms of rotary hammers (EP-A 015 185). In order to drive the impact mechanism of the known rotary hammer, the drive shaft carrying the coupling element is axially displaced against spring pressure at the work-piece by contact pressure of the tool held in the tool-holder of the rotary hammer, so that the truncated-cone-shaped peripheral surface of the coupling element is pressed into coupling engagement with a correspondingly truncated-cone-shaped annular surface of the drive element, and thus the drive element is rotated together with the driven drive shaft.

This known rotary hammer has a relatively complicatedly constructed drive element which consists of several parts and consequently requires expensive assembly. In addition, on account of the use of an axially displaceable drive shaft, there is also a relatively larger construction expense.

SUMMARY OF THE INVENTION

It is the object of the invention to create a rotary hammer with a simply constructed drive for the penumatic impact mechanism.

This object is achieved according to the invention by forming a rotary hammer of the type referred to above in such a way that the drive element has a rotating drive fin constituting a cam which extends between two rollers which have their axes of rotation perpendicular to the longitudinal axis of the piston and are fixed to its rear end.

In the rotary hammer according to the invention the drive element can thus consist of a single-piece part which can be produced very simply, possibly as a sintered part. The drive fin provided on this drive element extends between two rollers which are fixed to the rear end of the piston and can thus be arranged in the region of the longitudinal axis of the piston, which leads to an essentially axial input of power and hence to the avoidance of forces on the piston producing canting. Since moreover the rollers are always rotated in the one direction in operation there is no wear due to reversing the direction of rotation.

In a preferred form of the invention the coupling element has a coupling surface tapering from back to front which can be brought into engagement with a correspondingly formed surface of the drive element, and the drive element is provided between the coupling element and a tool-holder.

In a construction of this type the recoil of the tool in operation exerts a force pushing the piston backwards so that the roller fixed at the rear end of the piston and adjacent to the front of the drive fin presses against the drive fin and thereby exerts on the drive element a force which enhances the coupling between the latter and the coupling element.

In order to achieve a reliable separation of the coupling element from the drive element and hence a reliable disconnection of the impact mechanism, there may be provided between the coupling element and the drive element a pressure spring which, on termination of a force pressing the drive element into engagement with the coupling element, effects a reliable separation of the drive element from the coupling element.

In the previously described known rotary hammer (DE-OS No. 24 49 191) the impact mechanism is activated by the tool held in the tool-holder being pressed against the work-piece, whereby the tool spindle is axially displaced and thus, via the displacement of further intermediate elements, effects an axial displacement of the drive shaft and thus the engagement of the impact mechanism.

In the rotary hammer according to the invention this manner of engagement of the impact mechanism by pressure of the tool on a work-piece can be achieved more simply by providing between the tool spindle and the drive element a separating disk movable axially with respect to the longitudinal axis of the tool spindle, which separating disk is supported on one side via an axial-spherical or needle bearing at the tool spindle and on the other side via an axial-spherical or needle bearing at the drive element.

In such a construction the transmission of the axial force from the rotating tool spindle to the drive element arranged rotatably on the drive shaft is effected exclusively via an axially displaceable non-rotatably arranged separating disk, suitable bearings being provided between it (the separating disk) and the rotating tool spindle as well as between it and the intermittantly rotating drive element. Since the impact mechanism works only when the tool is engaged with the work-piece but is at other times disconnected, loads on the impact mechanism and its drive occur only for short periods, so that its life is considerably increased.

In order to be able to execute pure drilling operations also with a rotary hammer having this type of construction in which the impact mechanism is connected in by pressure of the tool on the work-piece, the rotary hammer may have a change-over device for activating and de-activating the impact mechanism with a rigid setting element movable in the axial direction of the piston between two end settings, one end of the setting element in the de-activating setting resting against the separating disk to prevent axial displacement of the tool spindle and the other end being in engagement with the peripheral surface of a setting pin which is rotatable to a limited extent by hand from the outside of the machine housing, which setting pin in each of its end settings has, in engagement with the other end of the setting element, upright rounded off zones one of which is further than the other from the mid-axis of the setting pin. Meanwhile the setting element is preferably in engagement with a spring which presses its other end against the setting pin.

A simply constructed change-over device of this type makes it possible, in the one end setting of the setting element, to restrain the tool spindle against axial displacement, for which purpose the one end of the setting element is in engagement with the non-rotating separating disk, hence no additional bearing is required between separating disk and setting element. In the other end setting of the setting element the latter does not prevent the axial displacement of the tool spindle. The displacement to the end settings can be effected by means of setting pin capable of limited rotation, having rounded-off zones provided in the peripheral surface so designed that they define the desired end settings of the setting element. The setting element is held in continuous engagement with the setting pin by means of the spring.

The setting element may be U-shaped and the free ends of its limbs may form the one end and the base the other end. The limbs may lie to either side of the rear end of the piston.

In operation of the impact mechanism, in order to avoid rotation of the piston in consequence of the torque exerted by the driven rollers, the rear end of the piston may be located in a stationary guide preventing twisting of the piston.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
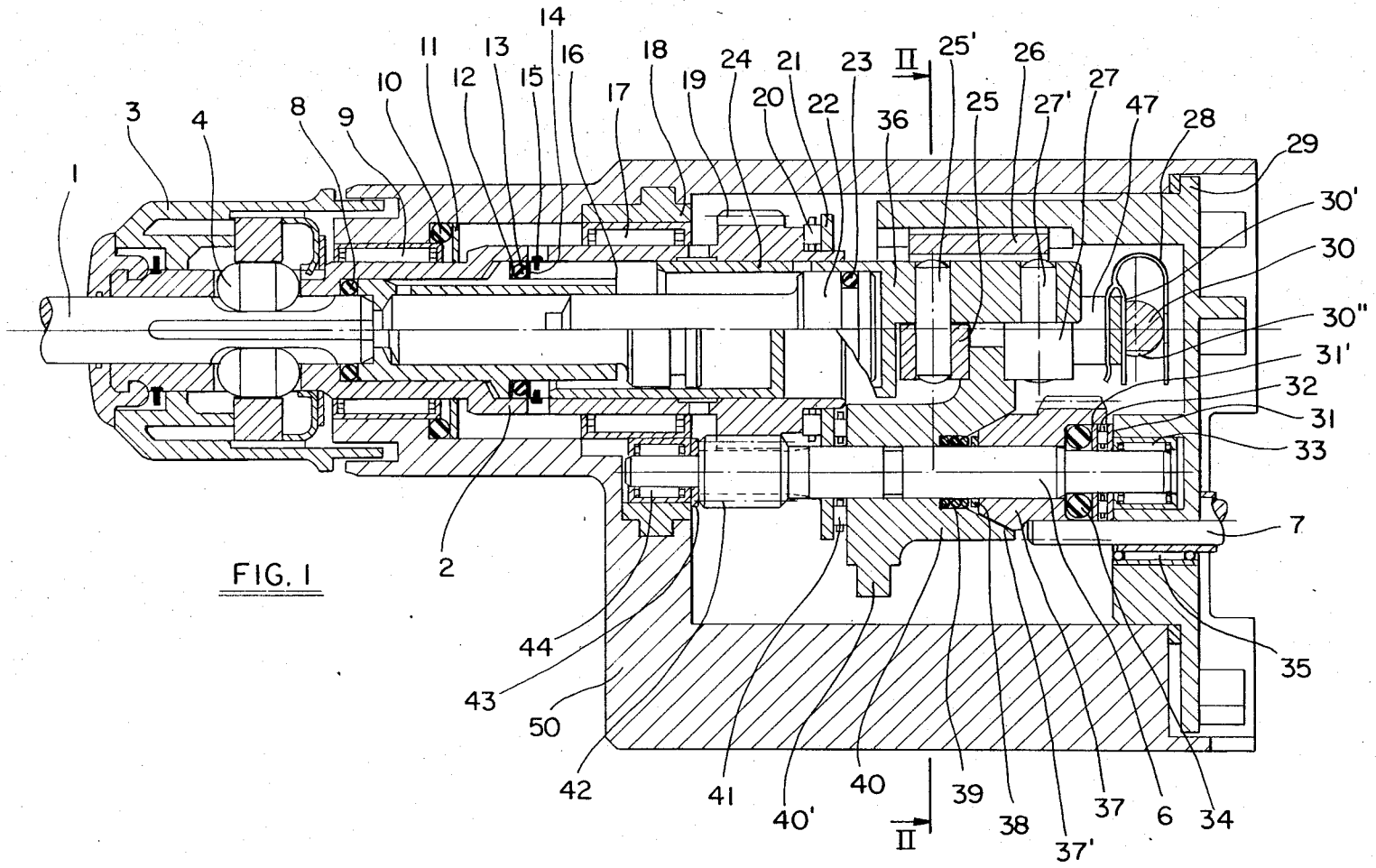
FIG. 1 shows in section the gear housing of a rotary hammer according to the invention together with a tool holder thereof.
Figure 3:
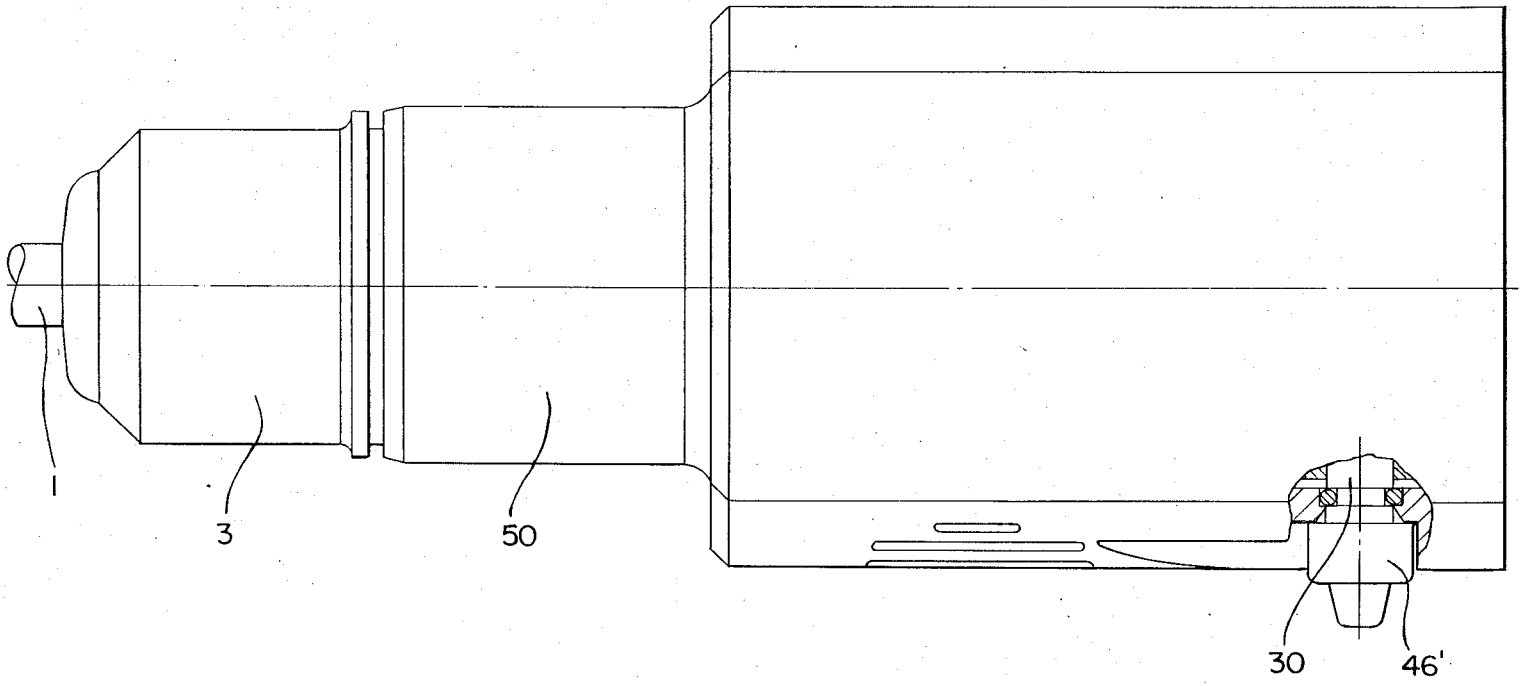
FIG. 3 shows an elevational view of the tool holder and the gear housing in which the gear housing is partially cut away in order to show the actuating lever for the pivot pin.

The illustrated gear housing 50 is connected at its rear end, at the right in FIGS. 1 and 3, to a motor housing, not illustrated, from which the armature-shaft spindle 7 of an electric motor extends into the gear housing 50. The armature-shaft spindle 7 is located with its front portion in a needle bearing 35 which is supported in a metal holder-member 29 inset into a gear housing 50 made of for example synthetic material. In this holder-member 29 there is also supported by means of a needle bearing 33 the rear end of a drive shaft 6 whose front end is held in a needle bearing 44 in the gear housing 50 or a metal inset element fixed in this gear housing 50. On the drive shaft 6 there is fixed, non-rotatably and axially non-displaceably, a coupling element 37 which has an external gear-tooth system which meshes with a pinion formed on the armature-shaft spindle 7.

In an annular recess open towards the rear in the coupling element 37 there is located a resilient damping ring 34 which has its front side resting against the base surface of the recess and its rear side resting against a disk 31'. Between this disk and a further disk resting against an annular surface of the holder-member 29, there is located an axial-spherical or needle bearing 32 which, on rotation of the coupling element 37 and thus of the damping ring 34 and the disk 31', prevents rubbing at the disk 31' which is maintained stationary. The damping ring 34 serves to cushion axial impacts which may be transmitted to the drive shaft 6 in operation.

On the drive shaft 6 there is also rotatably arranged a drive element 40 whose construction and functioning are explained below.

At the front end region of the drive shaft 6 there is formed a toothed gear system 42 which is in meshing engagement with an external toothed gear system 19 of the tool spindle 2 which is held rotatably in bearings 9 and 17. The tool front region of the tool spindle 2 forms a tool holder comprising a casing 3. The tool 1 has the usual axially running grooves in its shank which engage with retaining elements 4. The construction of tool holders of this type for rotatary hammers is known and therefore requires no detailed explanation.

Inside the tool spindle there is located a guide sleeve 16 in which the front end region of a beat piece 22 is guided axially and reciprocally so that, through an opening provided in the front end of the guide sleeve 16, its front end surface can impact on the rear end of the tool 1. Between the front end of the guide sleeve 16 and an annular shoulder of the tool spindle 2, there is arranged a resilient damping ring 8, and between an annular shoulder of the gear housing 50 and an annular shoulder of the tool spindle 2 there are located a resilient damping ring 10 and a disk 11. These damping rings serve for cushioning impacts during idling, while a resilient damping ring 13, which is provided between a disk 12 resting against an annular shoulder of guide sleeve 16 and a disk 14 whose displacement motion is limited by pins 15, effects the damping of backwards directed blows during operational impacting.

The beat piece 22 is guided with its larger-diameter rear end in a tubular piston 24 which is reciprocally movable axially in the tool spindle 2, an O-ring 23 inset in an annular groove of the beat piece 22 providing a seal at the inner surface of the tool spindle 2. In the prolonged rear end 36 of the tubular piston 24 there are fixed perpendicular to the longitudinal axis of the tubular piston two bearing-pins 25' and 27' which carry at their lower ends rotatable rollers 25, 27 repectively. The rear end 36 is disposed in a U-shaped guide 26 which is fixed in the holder-member 29 (FIG. 2), so that the rear end 36 is movable reciprocally in the guide 26 in the direction of the longitudinal axis of the tubular piston 24.

Between the rollers 25 and 27 there extends a drive fin 40' forming a guide cam, which is part of the drive element 40 previously referred to. This drive element is formed in one piece and may for example be a sintered part. The width of the drive fin 40' corresponds essentially with the clear distance between the rollers 25 and 27, so that the external surfaces of these rollers are in engagement with the lateral surfaces of the drive fin 40'.

Between the drive element 40, which is arranged rotatably and axially displaceable on the drive shaft 6, and the front end surface of the coupling element 37 there is arranged a pressure spring 39 surrounding the drive shaft 6, a disk 38 being provided between the rear end of the pressure spring 39 and the front end surface of the coupling element 37. From the external periphery of the front end surface of the coupling element 37 there extends a coupling surface 37' which widens towards the rear in the shape of a truncated cone. The drive element 40 has a correspondingly inclined engagement surface, shown in FIG. 1 in engagement with the coupling surface 37'.

When the rotary hammer is in the resting state the pressure spring 39 biases the drive element 40 and the drive shaft 6 in FIG. 1 towards the left, i.e. towards the front, so that the coupling surface 37' is not in engagement with the correspondingly shaped engagement surface of the drive element 40. In consequence of this displacement of the drive element 40 the separating disk 21, which has an opening surrounding the tool spindle 2 and an opening surrounding the drive shaft 6, is also displaced forwards, whereby the axial-spherical or needle bearing 20 provided between separating disk 21 and an annular shoulder of the tool spindle 2, and hence also the tool spindle 2, are displaced towards the left in FIG. 1, i.e. towards the front in the rotary hammer.

If in this operational setting the rotary hammer is switched on, then the rotating armature-shaft spindle 7 rotates the coupling element 37 via the toothed gear associated therewith, and thus also the drive shaft 6 which, via the meshing toothed gear systems 42 and 19, rotates the tool spindle 2 and thus also the tool 1. When the rotating tool 1 is brought into engagement with a work-piece the contact pressure effects, via the retaining elements 4, an axial displacement of the tool spindle 2 towards the rear, so that the bearing 20, the separating disk 21 and the axial-spherical or needle bearing 41 between the separating disk 21 and the drive element 40 are likewise displaced towards the rear, which leads to a shift of the drive element 40 in the direction of the coupling element 37 and thus to the engagement of coupling surface 37' and associated engagement surface of the drive element 40. By this means the drive element 40, together with the coupling element 37 rigidly fixed to the drive shaft 6, are rotated and the drive fin 40', which follows essentially the path of an obliquely-set circle, is guided between the rollers 25 and 27. This results in an axial reciprocating motion of the tubular piston 24 carrying the rollers 25 and 27 so that, due to build-up of excess pressure and resulting under-pressure, the beat piece 22 located in the tubular piston is displaced reciprocally in combination with the motion of the tubular piston 24 in the manner described in EP-A No. 015185, so as to impact on the rear end of the tool. Meanwhile the resulting recoil blows press the tubular piston 24 backwards and thereby intensify the pressure of the roller 25 on the drive fin 40' and thus also the engagement of the drive element 40 and the coupling element 37.

As soon as the tool 1 is no longer pressed against the work-piece, the spring 39 effects a separation of the coupling element 37 from the drive element 40 and thereby a stopping of the impact drive, so that the tubular piston 24 is no longer reciprocally displaced and hence the beat piece 22 no longer applies impacts to the rear end of the tool 1. In this connection it may be mentioned that in consequence of the absence of driving of the impact mechanism in this idling state of operation, no special interception device is required for the beat piece 22.

Figure 2:
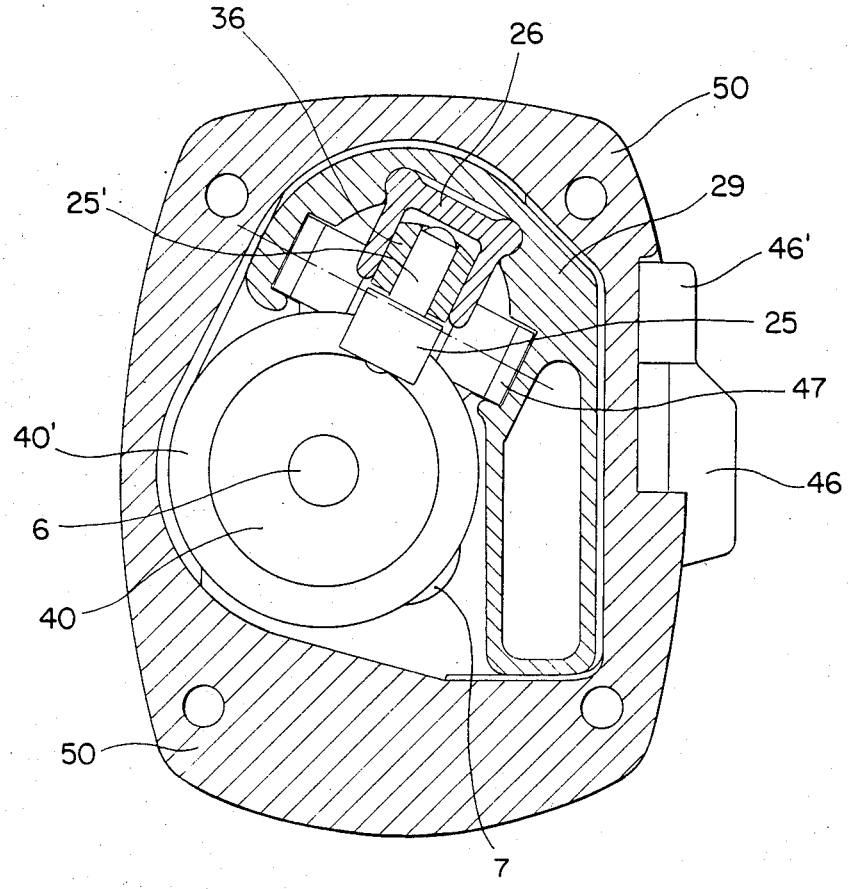
FIG. 2 shows a section on the line II—II of FIG. 1.

In order to activate or de-activate the impact mechanism at choice there is provided a U-shaped rigid setting element 47 whose limbs pass to either side of the rear end 36 of the tubular piston 24 and are led in recesses in the holder member 29 (FIG. 2). The base of this U-shaped setting element 47 rests against a rounded-off zone 30' (FIG. 1) of the peripheral surface of a setting pin 30 which is supported in the gear housing 50 so as to be rotatable to a limited extent and which extends transversely to the longitudinal axis of the tubular piston. The setting pin 30 has one end projecting from the gear housing 50 and carries at this end a hand lever 46 which is firmly connected by its head 46' with the projecting end of the setting pin 30.

As illustrated in FIG. 1, the base of the setting element 47 is embraced by one limb of a spring 28 whose other limb rests against the opposite-lying side of the setting pin 30 and which pulls the base of the setting element 47 towards the setting pin 30. In this way the base of the setting element 47 is always held in engagement with the actual rounded off zone at the periphery of the setting pin 30.

At the periphery of the setting pin 30 there are provided two rounded-off zones 30' and 30'', with the rounded-off zone 30' being at a shorter distance from the mid-axis of the setting pin 30 than the rounded-off zone 30''. Hence when the base of the setting element is rested against the rounded-off zone 30' the free ends of the limbs of the setting element 47 are located further to the right in FIG. 1, i.e. further to the rear in gear housing 50, than when the base of the setting element 47 rests against the rounded-off zone 30''. The operational case illustrated in FIG. 1, of the base of the setting element 47 resting against the rounded-off zone 30', is that in which the impact mechanism is activated, i.e. the impact mechanism is switched on by pressure of the tool 1 on the work-piece.

When the hand lever 46 is twisted by 90° (clockwise in FIG. 1), the base of the setting element 47 comes into engagement with the rounded off zone 30'', and in consequence of the greater distance of the rounded-off zone 30'' from the mid-axis of the setting pin 30 it becomes displaced towards the left in FIG. 1, i.e. towards the front in the gear housing. This displacement has the result that the free ends of the limbs of the setting element 47 come into engagement with the separating disk 21 and displace it to a frontal end setting, whereby the tool spindle 2 is also brought into this frontal end setting and is held therein. In this frontal end setting the coupling element 37 and the drive element 40 are not in engagement with one another. If now the tool 1 is pressed against a work-piece, then the engagement of the free ends of the limbs of the setting element 47 (resting against the rounded-off zone 30'') with the separating disk 21 prevents displacement of the tool spindle 2 to the rear and hence engagement of drive element 40 and coupling element 37, i.e. the rotary hammer is operating with a pure drilling action and the impact mechanism is de-activated.

The above described embodiments, of course, are not to be construed as limiting the breadth of the present invention. Modifications, and other alternative constructions, will be apparent which are within the spirit and scope of the invention as defined in the appended claims.

What is claimed is:

1. A rotary hammer, comprising:

a housing;

a piston reciprocally mounted in said housing for, in use, driving a beat piece;

a rotatable drive element having a continuous fin around its circumference which cooperates with said piston so that as said drive element is rotated said piston moves back and forth in said housing;

said piston being provided with a pair of rollers which are disposed to opposite sides of and drivingly engaged by said fin;

said drive element being rotatably mounted on a drive shaft provided with a coupling element fast thereon, and said drive element being displaceable axially along said shaft for bringing said drive element into and out of driving engagement with said coupling element;

a spring disposed between said coupling element and said drive elment and biasing them apart;

a rotatable tool spindle mounted in said housing and axially displaceable therein by contact pressure between a workpiece and a tool mounted in said rotary hammer to urge said drive element into driving engagement with said coupling element;

movement of said tool spindle being transmitted to said drive element by a separating disk;

said disk having two spaced apart holes therein through which extend respectively said tool spindle and said drive shaft, said tool spindle and said drive shaft being rotatable in said holes; and one side of said disk being acted upon by said tool spindle via a first needle bearing and an opposite side of said disk acting upon said drive element via a second needle bearing.

2. The rotary hammer of claim 1, including means for limiting axial displacement of said tool spindle so that said drive element cannot be axially displaced into engagement with said coupling element.

3. The rotary hammer of claim 2, wherein said limiting means comprises a rigid setting element, and a rotatable setting pin which projects through said housing and which can be rotated to advance said rigid setting element towards said tool spindle to limit said axial displacement of said tool spindle.

4. The rotary hammer of claim 3, including a spring retaining said rigid setting element against said setting pin.

5. The rotary hammer of claim 4, wherein said rigid setting element is generally U-shaped and has limbs of the U disposed to either side of said piston.

6. The rotary hammer of claim 4, further comprising a guide to inhibit rotation of said piston.

7. A rotary hammer, comprising:

a pneumatic impact mechanism having a beat piece driven by a reciprocating piston;

a rotatably driven drive shaft for driving said impact mechanism;

a coupling element fixed non-rotatably on said drive shaft for rotation therewith;

a drive element rotatably mounted on said drive shaft and optionally engageable with said coupling element by axial displacement relative to said drive shaft;

two rollers mounted on a rear end of said piston and having axes of rotation perpendicular to an axis of reciprocation of said piston;

said drive element having a circumferential fin extending about said drive shaft and defining a cam curve which extends between said two rollers for reciprocating said piston when said drive element is engaged with said coupling element;

a rotatable tool spindle axially displaceable by contact pressure on a workpiece of a tool located in said tool holder to effect engagement of said drive element with said coupling element;

a separating disk disposed transversely to and movable axially with respect to a longitudinal axis of said tool spindle;

said tool spindle and said drive shaft rotatably extending through holes in said disk; and said separating disk being supported on opposite sides by bearings axially engageable respectively with said tool spindle and said drive element.

8. The rotary hammer of claim 7, wherein said coupling element has a coupling surface tapering from rear to front and engageable with a correspondingly shaped surface of said drive element, and said drive element is located between said coupling element and a tool holder.

9. The rotary hammer of claim 7, comprising:

a change-over device for activating and de-activating said impact mechanism, and comprising a rigid setting element movable along said piston reciprocation axis between two end positions;

a first end of said setting element resting against said separating disk so as to prevent axial displacement of said tool spindle when said impact mechanism is deactivated;

a setting pin manually rotatable about a central axis thereof between two settings; and said setting pin having two stop zones which respectively engage a second end of said setting element in said two settings, one of said stop zones being at a greater distance from said central axis than the other.

10. A rotary hammer, comprising:

a housing;

a tool spindle mounted in said housing for rotation on a central axis and being displaceable therein along said axis by contact pressure between a workpiece and a tool mounted in and extending forwardly from said rotary hammer;

a piston mounted for reciprocation in said tool spindle along said axis;

said piston having a closed rear end from which extends rearwardly a rear extension;

said rear extension being offset to one side of said central axis and carrying two rollers having spaced apart rotational axes perpendicular to said central axis, said rollers being disposed behind and adjacent said piston closed rear end;

a rotatable drive element having a cam fin around its circumference, said fin passing between said two rollers to drivingly reciprocate said piston upon rotation of said drive element;

a drive shaft geared to said tool spindle for drivingly rotating said tool spindle;

said drive element being rotatably mounted on said drive shaft, and being displaceable axially along said drive shaft;

a coupling element rigidly secured on said drive shaft at a location rearwardly of said drive element;

means, actuated by rearward displacement of said tool spindle along said central axis, for moving said drive element rearwardly along said drive shaft for engagement with and rotation by said coupling element to reciprocate said piston, and for causing reaction forces from said piston against said drive element resulting from driving strokes of said rotary hammer to tend to increase the engagement of said drive element with said coupling element;

resilient means for biasing said drive element forwardly along said drive shaft to uncouple said drive element from said coupling element when not actuated by said rearward displacement of said tool spindle; and a stationary guide mounted in said housing, said guide having an elongate channel therein extending parallel to said central axis but offset to said one side thereof, said piston rear extension slidably but non-rotatably engaging in said channel.

11. A rotary hammer, comprising:

a housing;

a tool spindle rotatably mounted in said housing;

a hollow piston reciprocally mounted in said tool spindle for driving a beat piece mounted for reciprocation in said piston;

a rotatable drive element having a continuous cam fin around its circumference which cooperates with said piston so that as said drive element is rotated said piston moves back and forth in said tool spindle;

said piston having a rearward extension on which is mounted a pair of rollers which are disposed to opposite sides of and drivingly engaged by said fin, said rearward extension being offset to one side of a central axis about which said tool spindle rotates and along which said piston reciprocates;

said rollers being arranged to rotate about axes perpendicular to said central axis;

said drive element being freely rotatably mounted on a drive shaft provided with a coupling element fast thereon, said drive element being displaceable axially along said shaft for bringing said drive element into and out of driving engagement with said coupling element;

said coupling element having a surface which tapers towards said drive element, and said drive element having a correspondingly tapered recess;

a spring disposed between said coupling element and said drive element and biasing them apart;

said spindle being axially displaceable in said housing by contact pressure between a workpiece and a tool mounted in said rotary hammer to urge said drive element into driving engagement with said coupling element;

axial movement of said tool spindle being transmitted to said drive element by a non-rotatable separating disk;

one side of said disk being acted upon by said tool spindle via a first bearing and an opposite side of said disk acting upon said drive element via a second bearing, said tool spindle and said drive shaft both passing through said disk and said disk being movable along both said tool spindle and said drive shaft;

means for optionally limiting axial displacement of said tool spindle so that said drive element cannot be axially displaced into engagement with said coupling element;

said limiting means comprising a rigid setting element, and a rotatable setting pin which projects through said housing transversely to said central axis and which can be manually rotated to advance said rigid setting element towards said tool spindle to limit said axial displacement of said tool spindle;

resilient means for biasing said rigid setting element against said setting pin;

said rigid setting element being generally U-shaped and having limbs of the U disposed to either side of said piston parallel to said central axis, free ends of said limbs engaging said disk to limit movement thereof to effect said limiting axial displacement of said tool spindle, a base portion of said U connecting said limbs engaging said setting pin; and a guide mounted in said housing to inhibit rotation of said piston, said guide having a channel in which said rearward extension of said piston is slidably engaged.

* * * * *